US008771375B2

(12) United States Patent
Rodengen et al.

(10) Patent No.: US 8,771,375 B2
(45) Date of Patent: Jul. 8, 2014

(54) ANTIMICROBIAL TENNIS BALL

(71) Applicants: Jeffrey L. Rodengen, Fort Lauderdale, FL (US); Roger P. Tyzzer, Hope Island (AU)

(72) Inventors: Jeffrey L. Rodengen, Fort Lauderdale, FL (US); Roger P. Tyzzer, Hope Island (AU)

( * ) Notice: Subject to any disclaimer, the term of this patent is extended or adjusted under 35 U.S.C. 154(b) by 37 days.

(21) Appl. No.: 13/676,357

(22) Filed: Nov. 14, 2012

(65) Prior Publication Data

US 2013/0143700 A1 Jun. 6, 2013

Related U.S. Application Data

(60) Provisional application No. 61/682,825, filed on Aug. 14, 2012, provisional application No. 61/606,569, filed on Mar. 5, 2012, provisional application No. 61/566,887, filed on Dec. 5, 2011.

(51) Int. Cl.
*D06M 13/322* (2006.01)

(52) U.S. Cl.
USPC ..... 8/116.1; 8/181; 8/188

(58) Field of Classification Search
USPC ..... 8/116.1, 181, 188
See application file for complete search history.

(56) References Cited

U.S. PATENT DOCUMENTS

| | | | | |
|---|---|---|---|---|
| 3,730,701 | A * | 5/1973 | Isquith et al. | 504/153 |
| 4,282,366 | A * | 8/1981 | Eudy | 556/413 |
| 6,221,944 | B1 | 4/2001 | Liebeskind et al. | |
| 6,726,582 | B1 | 4/2004 | Kuo et al. | |
| 7,690,543 | B1 * | 4/2010 | Edwards-Delgado et al. | 224/677 |
| 2004/0266546 | A1 | 12/2004 | Huang | |

FOREIGN PATENT DOCUMENTS

| | | |
|---|---|---|
| JP | 2004033467 | 2/2004 |
| WO | WO 2009/014435 | 1/2009 |

* cited by examiner

*Primary Examiner* — Eisa Elhilo
(74) *Attorney, Agent, or Firm* — Robert M. Schwartz

(57) ABSTRACT

An antimicrobial sports equipment piece used in a sport or game, namely an antimicrobial tennis ball, is described. Also described are methods of using an antimicrobial tennis ball and methods of preventing, inhibiting, or killing microbes contacting the tennis ball during play to prevent or inhibit contamination by a microbe or cross-contamination between persons contacting the tennis ball.

18 Claims, 4 Drawing Sheets

SECTION A-A OF FIG.1

SECTION B-B OF FIG.3

SECTION C-C OF FIG.5

ANTIMICROBIAL TENNIS BALL

PRIORITY TO RELATED APPLICATIONS

This application claims benefit of U.S. Provisional Application No. 61/682,825 filed Aug. 14, 2012, U.S. Provisional Application No. 61/606,569 filed Mar. 5, 2012, and U.S. Provisional Application No. 61/566,887 filed Dec. 5, 2011, the disclosures of which are incorporated herein by reference in their entirety.

BACKGROUND OF THE INVENTION

The present invention relates to killing, preventing, inhibiting or prohibiting the growth, colonization, or proliferation of microbes, such as bacteria, algae or fungi, or the like, on the surface of objects used in sports, such as a ball used in a sport, e.g., a tennis ball, or on the surface of objects or equipment handled or used in sports such as textiles or materials attached to the handle of a bat or racquet, or on the surface of sport clothing or uniforms, including pads or sweatbands. The subject invention can be carried out by applying and chemically bonding, e.g., during the manufacturing process, an antimicrobial agent to an object, namely, an item used in connection with a sport as described herein, e.g., a tennis ball. Preferred antimicrobial agents are organosilanes containing quaternary ammonium halides and hydrolyzable alkoxy groups bonded to silicon.

In normal use a tennis ball may come into contact with, and accumulate on its surface, a wide spectrum of pathogenic and non-pathogenic bacteria, algae or fungi. In play, the ball is handled by two or four players in an amateur match, and by players, ball persons, spectators and others in professional matches. Players perspire, cough, sneeze and in other ways transfer a resilient bloom of microscopic contagions onto the surface of the ball.

Further, microbial detritus can be introduced to the surface of the tennis court by the agency of the shoes of players, workmen, officials and others in rather constant traffic. The vast majority of tennis courts are not cleaned on a daily basis, which allows for the introduction and accumulation of mammalian, reptilian, or avian fecal matter or urine, along with a wide menu of insects or microbes which are attracted to such waste and nutrients excreted therein. In short, the typical tennis ball, in use in a tennis game, has the ability to host enormous colonies of contact-transmissible, and potentially pathogenic or communicable, health-threatening microbes.

Organosilanes containing quaternary ammonium halides and hydrolyzable alkoxy groups bonded to silicon have been employed in a wide variety of applications. The hydrolyzable groups enable these compounds to form bonds to substrates that contain hydroxy, alkoxy, oxide and similar reactive moieties.

Organosilane quaternary nitrogen compounds have also been employed effectively in eliminating and reducing bacterial, viral and fungal contamination when applied to a variety of surfaces including metal, glass, plastics, rubber, ceramics and fabrics including wool, cellulose, cotton, acetates and nylon.

Commercial quaternary ammonium organosilanes are commercially available as 42% active material in methanol under the trademark Dow Corning 5700 (3-(trimethoxysilyl) propyldimethyloctadecyl ammonium chloride) from Aegis Environmental Management, Inc. of Midland, Mich. and Requat 1977 (3-(trimethoxysilyl)-propyldidecylmethyl ammonium chloride) by Sanitized Inc. of New Preston, Conn.

Octadecyldimethyl(3-trimethoxysilylpropyl)ammonium chloride (Cat. No. SIO6620.0) as a 60% active solution in methanol, tetradecyldimethyl(3-trimethoxysilylpropyl)ammonium chloride (Cat. No. SIT7090.0) as a 50% solution in methanol and didecylmethyl(3-trimethoxysilylpropyl)ammonium chloride (Cat. No. SID3392.0) as a 42% solution in methanol are offered by Gelest, Inc. of Tullytown, Pa. They are often applied from solvent solutions such as lower alcohols.

Organosilicon ammonium compounds were first taught by Roth in U.S. Pat. No. 3,560,385, describing their use in protecting glass surfaces. The use of these compounds for antimicrobial purposes is taught in U.S. Pat. No. 3,730,701 to Isquith et al., describing effective use in controlling algae growth in aqueous solutions.

Algae inhibition by application of an organosilicon ammonium compound was also taught in U.S. Pat. Nos. 3,794,736 and 3,860,709. The inhibition of algae growth on solid surfaces such as cellulose acetate following treatment with organosilane quaternary ammonium materials was described by Abbott et al. in U.S. Pat. No. 3,817,739. Abbott et al. in U.S. Pat. No. 3,865,728 again describes algicidal reduction on fibrous materials including polyesters as well as cellulose acetate.

In U.S. Pat. No. 4,282,366 organosilicon ammonium compounds are used to render paper substrates resistant to growth of microorganisms. Similarly, Klein in U.S. Pat. No. 4,394,378 claims 3-(trimethoxysilyl)propyldidecylmethyl ammonium chloride as effective against bacteria and fungi on siliceous surfaces, wood, metal, leather, rubber, plastic and textiles.

U.S. Pat. No. 4,406,892 describes treatment of cellulosic fabrics to prevent the growth of disease causing organisms.

What is needed is an antimicrobial agent incorporated into or onto the surface of a material by chemical bonding, wherein the material can be used in manufacturing sports equipment or an article used in a sport or game.

It is therefore an object of the subject invention to provide an article of manufacture, such as sports equipment, preferably a tennis ball, comprising an antimicrobial agent which can prevent, inhibit, or kill undesirable or harmful microbes. The presence of the antimicrobial agent can prevent or eliminate contamination of the surface of the equipment coming into contact with an undesirable or harmful microbe.

It is another object of the subject invention to provide a method of using an antimicrobial agent to impart antimicrobial properties to sports equipment by integrating or incorporating the antimicrobial agent into a material used in association with, or forming a part of, the sports equipment.

A further object of the invention comprises a method of preventing or inhibiting cross-contamination of microbial pathogens during a sports event or game wherein the method employs an antimicrobial agent incorporated into or onto a material forming part of sports equipment used by a player or other person involved in the game or event.

BRIEF SUMMARY OF THE INVENTION

The subject invention concerns an antimicrobial agent incorporated into or bonded to a material making up the surface of an equipment piece used in a sport or game, wherein the antimicrobial agent can be useful to prevent or inhibit contamination of the equipment piece by microbes, and thereby prevent or inhibit cross-contamination to persons subsequently contacting the equipment piece during play of the sport or game.

For purposes of describing the invention, herein, reference is made to a tennis ball as the equipment piece, wherein the felt material forming the outer surface of the tennis ball comprises the antimicrobial agent. However, it would be readily understood that the invention can be applicable to a variety of materials and have a plurality of uses for sports equipment pieces in addition to a tennis ball.

A tennis ball is a pressurized, hollow, inner rubber core, surrounded by a felt cover. In accordance with one embodiment of the subject invention, the felt cover can comprise an antimicrobial agent bonded to the material used to form the felt cover.

The material used for the felt cover of the tennis ball comprises filaments or fibers having various percentages of wool, nylon, cotton, polyester, or the like. The subject invention therefore comprises an antimicrobial agent chemically bonded to the filaments or fibers of wool, nylon, cotton, polyester, or the like.

International standards for the size, weight, compressibility and texture of a tennis ball are established and governed by the International Tennis Federation (ITF) in London, England. Accordingly, the outer surface or felt material comprising an antimicrobial agent in accordance with the subject invention preferably does not alter or modify the size, weight, compressibility or texture of the tennis ball so that it remains compliant with such standards.

Thus, the subject invention comprises a tennis ball having a pressurized inner rubber core and a felt cover, said felt cover comprising an antimicrobial agent that mechanically interacts with a microbe contacting said felt cover to inhibit, prevent proliferation of, or kill the microbe.

The subject invention further comprises a method for providing an antimicrobial sports equipment piece which inhibits, prevents, or kills a microbe contacting the sports equipment piece during use of the equipment in a sport or game. This method comprises: providing an antimicrobial agent which bonds to a material used in forming an outer surface of the equipment piece; bonding the antimicrobial agent to the outer surface material during the manufacture of the equipment (prior to its final manufacture), and manufacturing the equipment using the surface material comprising the antimicrobial agent.

Preferably, the method is useful for the manufacture of a tennis ball having antimicrobial properties.

Another embodiment of the invention concerns a method for inhibiting or preventing contamination of a sports equipment piece during use of the equipment piece during a sport or game. This method comprises: providing an equipment piece comprising an antimicrobial agent bonded to an outer surface thereof, and using the equipment piece during a sport or game wherein the antimicrobial agent prevents, inhibits, or kills a microbe contacting the equipment piece during its use in the sport or game.

Advantageously, this method further prevents or inhibits cross-contamination between two or more persons coming into contact with the sports equipment piece during its use in the sport or game. This method also preferably comprises the use of an antimicrobial tennis ball for preventing or inhibiting contamination of microbes encountered from contact with the ground or cross-contamination from another player, line judge or official, ball boy, coach, or the like who may also contact the equipment (ball).

The purpose of the present invention is to prohibit or nearly completely inhibit the survival and growth of a broad spectrum of microbes, such as bacteria, algae and fungi, on the surface of the ball. Preferably, the antimicrobial agent has an efficacy of greater than 99% against the microbes and retains such efficacy for the average life of the ball.

The felt material used for the outer surface of a tennis ball is manufactured by a highly-specialized and known process, which can be modified to introduce an antimicrobial agent using an exhaust or pad method application process. The anti-microbial agent adheres or chemically bonds to the fibers or filaments forming the felt material and thereby becomes incorporated into or onto the material to provide a material having antimicrobial properties.

To reduce the risk of microbial resistance to the antimicrobial agent, it is preferred to employ an antimicrobial agent having a mechanism of action that physically or mechanically impairs the proliferation of, or destroys, the microbe. For example, a preferred antimicrobial agent useful according to the subject invention is a polymeric organofunctional silane compound comprising a carbon chain which can penetrate the microbe and thereby inhibit or kill the microbe.

A preferred silane compound useful according to the subject invention is 3-trimethoxysilylpropyloctadecyldimethyl ammonium chloride having the general chemical formula:

$$(CH_3O)_3Si(CH_2)_3N^+(CH_3)_2C_{18}H_{37}Cl^-$$

Silane compounds useful in accordance with the subject invention advantageously provide one or more of the following properties:

long-lasting,
non-leaching,
non-toxic,
odorless,
non-slippery, and
non-fiber stiffening.

Antimicrobial compounds used according to the subject invention further provide or impart to the equipment piece a property which is at least bacteriostatic, algae-static or fungistatic, and can provide or impart bacteriocidal, algicidal, or fungicidal properties to the equipment piece.

The physical structure of the antimicrobial compound useful for the subject invention is preferably within the size range of 2 to 3 nanometers. The silane moiety can be useful for its capability to bond to a textile fiber or filament. The long carbon chain moiety of the compound effectively forms a chemical "sword" which can disrupt or penetrate the outer membrane of the microbe. Preferably the carbon chain comprises a charge, more preferably a positive charge, which can electrostatically attract the microbe and thereby incapacitate the microbe. Disruption of the outer membrane of the microbe by the compound, namely, the carbon chain moiety of the compound, effectively kills the microbe by physical or mechanical means, e.g., electrostatic discharge, rather than a potentially leaching or toxic chemical, means.

An antimicrobial compound used in accordance with the subject invention does not kill the microbe by chemical means, e.g., by disrupting the metabolic function of the microbe or by introduction of a toxic substance to the microbe.

A felt material bonded with the antimicrobial agent can be used in a conventional manufacturing process for making a tennis ball. For example, the finished (treated) felt material comprising the antimicrobial agent can be provided in bulk rolls. In accordance with a conventional tennis ball manufacturing process, the bulk felt roll is die-cut into bar-bell or figure-eight shaped pieces, which are then adhered to the pressurized rubber core. Although tennis balls are exposed to very high temperatures during the manufacturing process, such temperatures are well within the tolerance limitations of the antimicrobial agent, retaining its molecular and polymeric structure, as well as its covalent bond to the felt material.

Finished tennis balls comprising the antimicrobial felt material are contained within pressurized "cans" or "sleeves" to minimize the escape of pressure from the rubber core. Advantageously, none of the ITF regulatory standards for the certification of tennis balls are exceeded, nor is the color, texture nor scent of the ball altered by the presence of the antimicrobial agent. Although a finished tennis ball may receive subsequent antimicrobial treatment by spray or mist, i.e., applying the antimicrobial agent to the finished ball surface without chemically bonding the agent to the material, subsequent surface application is significantly less efficient, cost prohibitive and time-consuming as compared to the invention disclosed herein.

DETAILED DESCRIPTION OF THE PREFERRED EMBODIMENT

The present invention is an equipment piece or article used in a sport or game which comprises an antimicrobial agent chemically bonded to the surface material used in the manufacture of the equipment piece. The presence of the antimicrobial agent can prevent or inhibit contamination by microbes contacting the equipment during use and, further, can prevent or inhibit cross-contamination between two or more players of the sport or game.

A preferred embodiment of the invention comprises a tennis ball having an antimicrobial agent chemically bonded to, or incorporated into, the textile or material used in forming the outer felt surface of the tennis ball.

Figure 1:
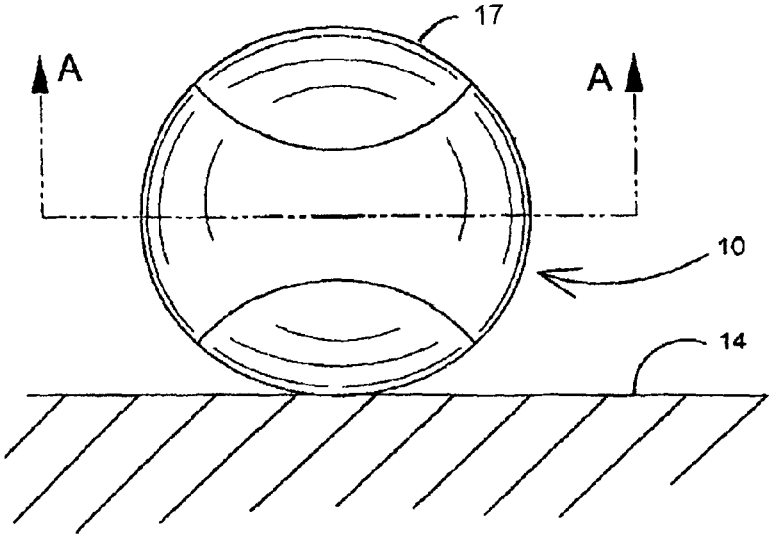
FIG. 1 is a side view of a tennis ball on a flat surface.

The subject invention can be understood by the description provided herein, and is further supported and understood by reference to the accompanying drawings. As shown in FIG. 1, a tennis ball 10 of the present invention is shown at rest on a flat surface 14, such as a tennis playing surface, e.g., a tennis court, where ball 10 would continually come in contact with surface 14 during a game of tennis. The outward appearance of ball 10 and all characteristics of ball 10 are substantially if not identical to an ordinary tennis ball without the coating or antimicrobial agent of the present invention.

Figure 2:
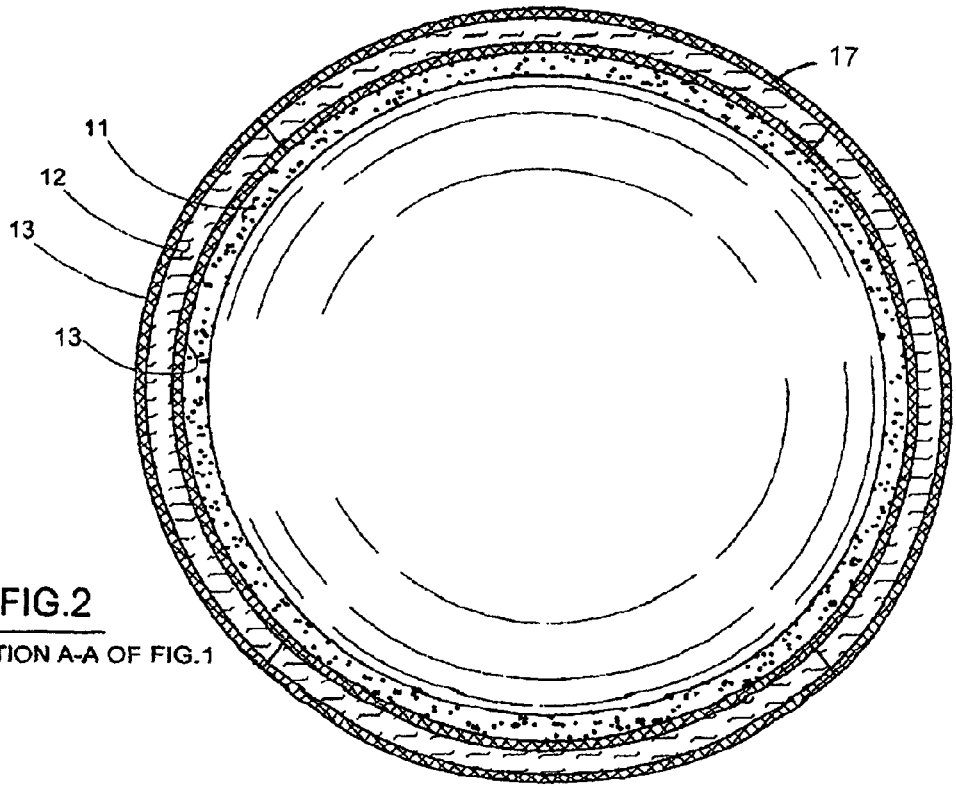
FIG. 2 is a cross sectional schematic view of the tennis ball of FIG. 1, along section line A-A.

A cross section of ball 10 is shown in FIG. 2, with an inner rubber core 11. Surrounding core 11 is a treated felt cover 12 that has been treated with an antimicrobial agent 13 shown schematically to be on both sides of cover 12. The application of antimicrobial agent 13 to cover 12 is described below.

Figure 3:
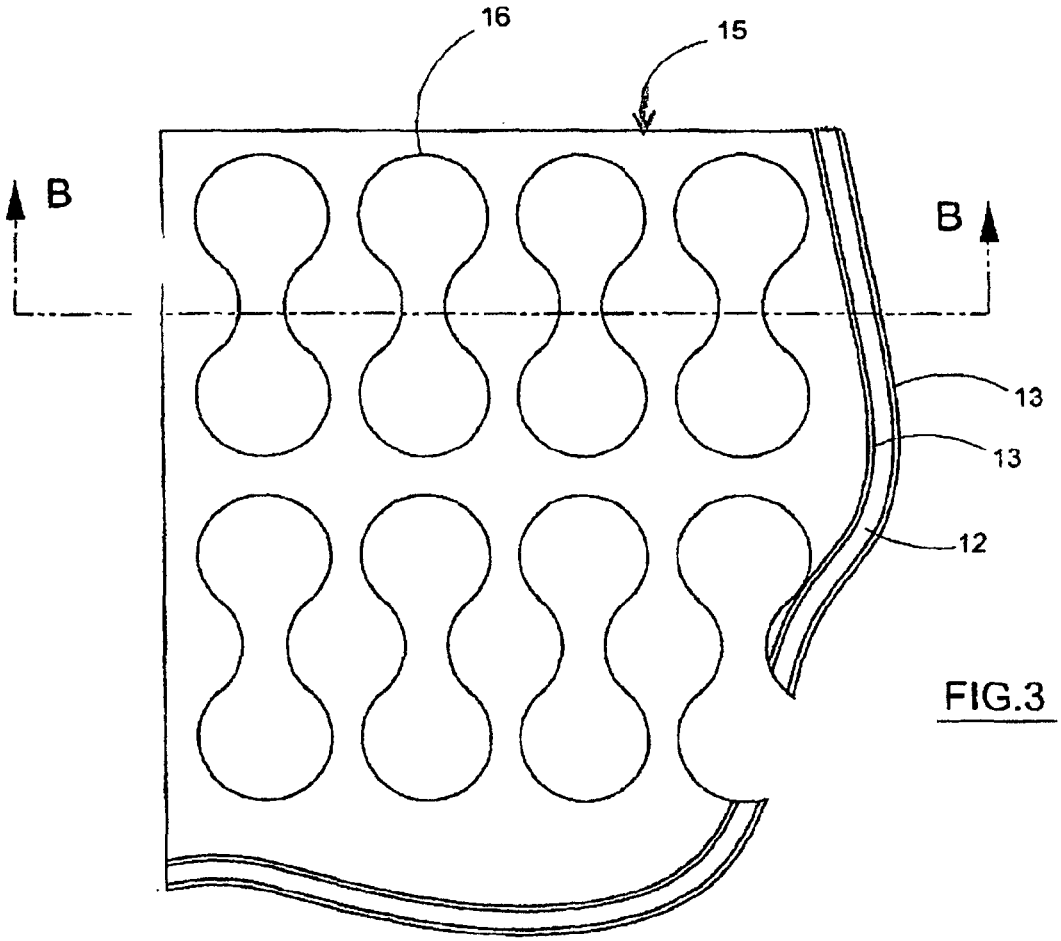
FIG. 3 is plan view of a portion of a felt roll after the figure eight shaped cut outs have been removed from the felt roll.
Figure 4:
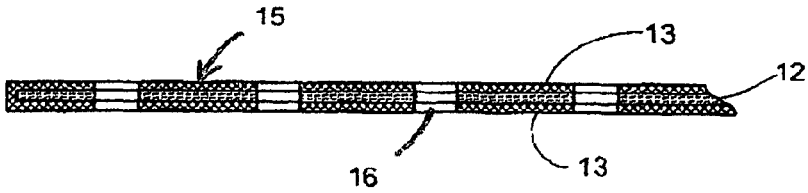
FIG. 4 is a cross sectional schematic view of the felt roll taken along section line B-B from FIG. 3 after the application of the ABA-antimicrobial.

A portion of a treated felt roll 15 is shown in FIG. 3 with openings 16 where several of the figure eight cutouts 17 have been punched out of felt roll 15. A schematic sectional view of felt roll 15 is shown in FIG. 4 where the felt 12 is surrounded by antimicrobial agent 13.

Figure 5:
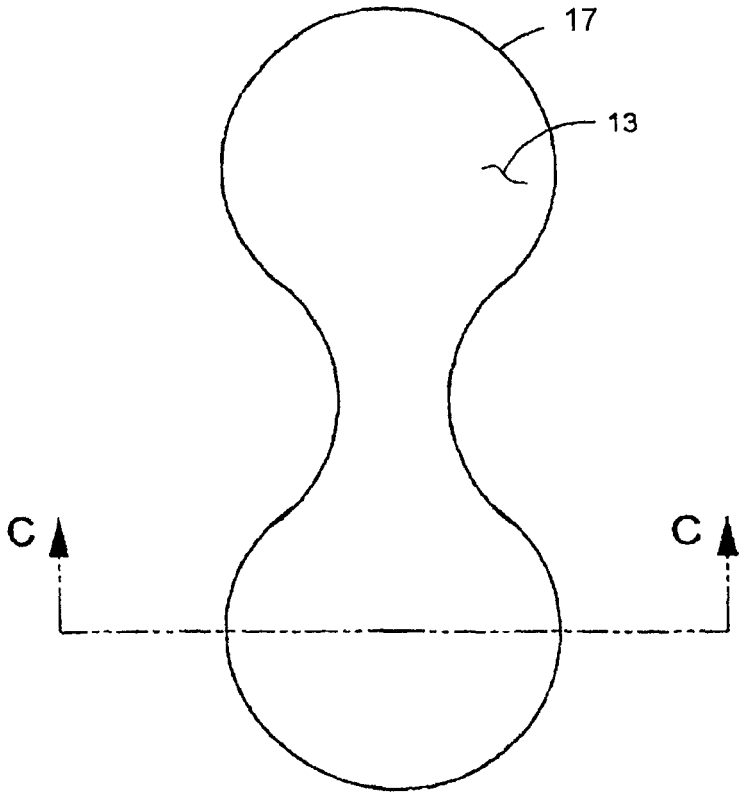
FIG. 5 is a plan view of the figure eight shaped cut out.
Figure 6:
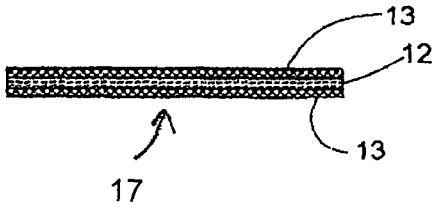
FIG. 6 is a cross sectional schematic view of the figure eight shaped cut out taken along section line C-C from FIG. 5 after the application of the ABA-antimicrobial.

Each ball 10 has two figure eight cutouts 17 as is known in the art of manufacturing tennis balls. These cutouts 17 form the outside exterior of a tennis ball 10. A treated figure eight cutout 17 is shown in FIG. 5. A schematic sectional view along lines C-C is shown in FIG. 6.

The antimicrobial agent 13 incorporated into or bonded to the felt 12 is approved by the Environmental Protection Agency (EPA). Antimicrobial agent 13 is chemically bonded to the felt 12 fibers or filaments of the textile material and effectively can provide a microscopic bed of spikes that punctures the cell membranes or cell walls of microbes as they come to rest on the surface of ball 10 on the felt 12 covered with agent 13.

In use, the treated tennis balls 10 are made by covering a rubber core 11 with a felt 12 that has been treated with an agent 13. The felt 12 used on tennis balls is typically made up of various percentages of wool and/or cotton fiber and nylon and/or polyester filaments. The felt roll 12 is put in a bath of an antibacterial agent 13 and the wool and cotton fibers and polyester and nylon filaments of the felt are coated with agent 13. After drying, the roll 15 is dye cut into figure-eight shaped cutout pieces 17 that are adhered, with a polymer bond, to a pressurized inner rubber core 11. The finished treated balls 10 are then placed in pressurized cans to minimize the escape of pressure from the rubber core 11.

The antimicrobial agent is preferably a polymeric organofunctional silane compound comprising a carbon chain which can penetrate the microbe and thereby inhibit or kill the microbe.

Preferred silane compounds useful as an antimicriobial agent according to the subject invention include compounds having the following formulae:

$$(CH_3O)_3Si(CH_2)_3N^+(CH_3)_2C_{18}H_{37}Cl^-$$

$$(CH_3CH_2O)_3Si(CH_2)_3N^+(CH_3)_2C_{18}H_{37}Cl^-$$

$$(CH_3O)_3Si(CH_2)_3N^+(CH_3)_2C_{18}H_{37}Br^-$$

$$(CH_3O)_3Si(CH_2)_3N^+(C_{10}H_{21})_2CH_3Cl^-$$

$$(CH_3O)_3Si(CH_2)_3N^+(CH_3)_2C_{14}H_{29}Cl^-$$

$$(CH_3O)_3Si(CH_2)_3N^+(CH_3)_2C_{14}H_{29}Br^-$$

$$(CH_3O)_3Si(CH_2)_3N^+(CH_3)_2C_{16}H_{33}Cl^-$$

A most preferred silane compound useful according to the subject invention is 3-trimethoxysilylpropyloctadecyldimethyl ammonium chloride, which is commercially available, and has a general chemical formula:

$$(CH_3O)_3Si(CH_2)_3N^+(CH_3)_2C_{18}H_{37}Cl^-$$

Silane compounds useful in accordance with the subject invention advantageously provide one or more of the following properties:

long-lasting,
non-leaching,
non-toxic,
odorless,
non-slippery, and
non-fiber stiffening.

Further, the presence or use of the antimicrobial agent does not exceed the established standards or requirements regarding size, weight, color, or the like, of the finished tennis ball.

Antimicrobial compounds according to the subject invention further provide at least bacteriostatic, algae-static or fungi-static properties, and preferably provide bacteriocidal, algicidal, or fungicidal properties to the tennis ball. The antimicrobial agent can also be effective against viruses, i.e., antiviral.

Antimicrobial agents useful in accordance with the subject invention are commercially available. For example, 3-trimethoxysilylpropyloctadecyldimethyl ammonium chloride is available from AegisAsia (Singapore) or Aegis Environmental Management, Inc. (Midland, Mich.). Information regarding the details, including the activity and use, of the antimicrobial agent, 3-trimethoxysilylpropyloctadecyldimethyl ammonium chloride, are available at www.aegisasia.com, incorporated herein by reference in its entirety.

The antimicrobial agent 13 when applied to a surface or incorporated into a material such as felt 12, creates a micro-biostatic antimicrobial coating 13 on the surface of felt 12 that inhibits a wide array or broad spectrum of bacteria, mold, mildew, algae, and fungi or yeast. The micro-biostatic antimicrobial coating 13 forms a protective surface by forming a nano-sized bed of spikes that disrupts the microorganism's membrane, resulting in the loss of energy in the microbe and its ultimate demise. This provides an advantageous strategy for inhibiting microorganisms without the use of unsafe heavy metals or poisons.

Figure 7:
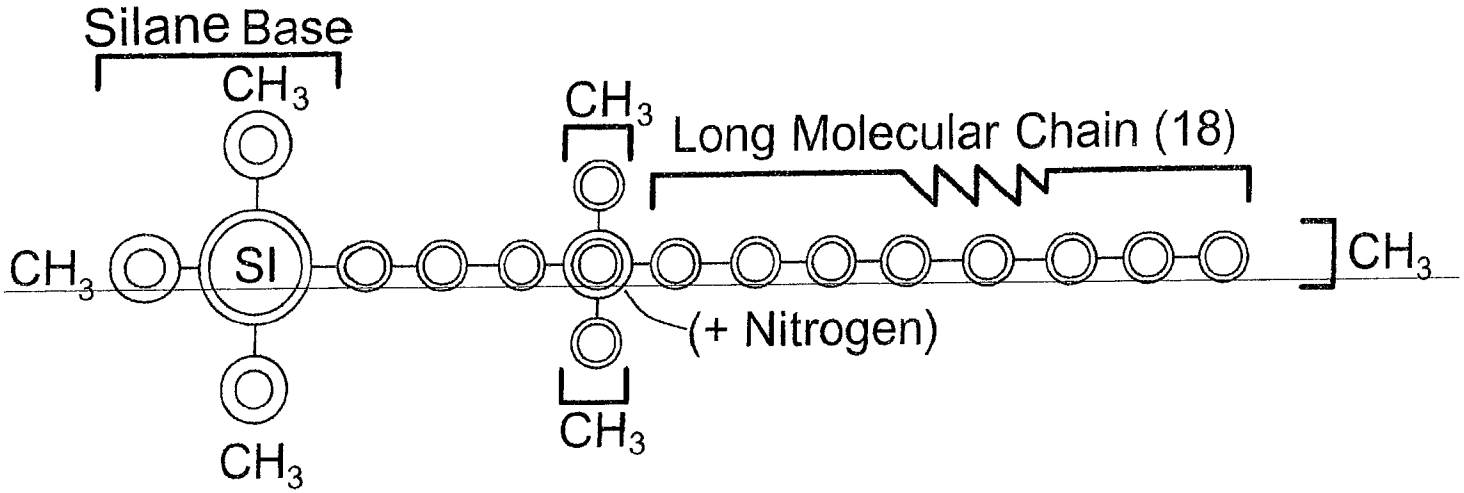
FIG. 7 is a representation of an organofunctional antimicrobial silane compound in accordance with the subject invention, illustrating functional moieties of the compound.

The molecule of the antimicrobial agent comprises a plurality of functional moieties. The functional moieties are illustrated in FIG. 7. The silane moiety of the molecule can form a strong bond to the surface of the substrate material, such as the fiber or filament of the tennis ball felt material. Advantageously, the surface to which the silane antimicrobial agent is bonded can be either porous or non-porous.

The long carbon chain moiety of the antimicrobial agent molecule carries a chemical charge that can electrostatically attract a microbe thereto. Preferably, the long carbon chain carries a positive charge attracting a negatively charged microbe.

The long carbon chain moiety also advantageously forms a chemical "sword" or "spike" which can physically (mechanically) pierce or penetrate through the outer membrane of the microbe. By coming into contact with the "sword", the microbe is effectively inhibited or killed. Aligned or polymerized together on the surface of the article, a plurality of these "swords" or "spikes" forms a microscopic bed of nails that stand or jut out from the surface and eradicate microbes by disrupting the outer membranes, resulting their demise.

The long chain of atoms that make up the spike are preferably greater than 5 carbon atoms and less than 50 carbons in length, so they are long enough to pierce the cell membranes or cell walls of various microbes. More preferably, the long carbon chain is about 10-25 carbons in length, and most preferably about 15-20 carbons in length. The preferred antimicrobial agent, 3-trimethoxysilylpropyloctadecyldimethyl ammonium chloride, has a long chain of 18 carbons.

Being only about one thousandth the diameter of a human hair, the carbon chain moieties of the antimicrobial agents of the subject invention are too small to harm large cells in mammals.

Further advantages of an antimicrobial agent of the invention include: it is EPA Registered; it is odorless and colorless; it is highly durable; it is non-toxic; it is water based; it provides long term prevention of a wide range of microbial growth; it protects a wide range of surfaces both porous and non-porous; it dries rapidly; it is non-leaching; it has no off-gassing.

The antimicrobial properties of quaternary ammonium organosilanes are effective against a wide range of pathogens including, but not limited to:

Bacteria:

Gram Positive Bacteria: *Citrobacter freundii, Citrobacter diversus, Corynebacterium diptheriae, Diplococcus pneumonia, Micrococcus* sp. (I), *Micrococcus* sp. (II), *Micrococcus* sp. (III), *Mycobacterium* spp., *Staphylococcus albus, Staphylococcus aureus, Staphylococcus citrens, Staphylococcus epidermidis, Streptococcus faecalis*, and *Streptococcus pyogenes.*

Gram Negative Bacteria: *Acinetobacter calcoaceticus, Enterobacter aerogenes, Enterobacter aglomerans* (I), *Enterobacter aglomerans* (II), *Escherichia coli, Klebsiella pneumonia, Nisseria gonorrhoeae, Proteus mirabilis, Proteus morganii, Proteus vulgaris, Providencia* spp., *Pseudomonas, Pseudomonas aeruginosa, Pseudomonas fragi, Salmonella choleraesuis, Salmonella enteritidis, Salmonella gallinarum, Salmonella paratyphi*, A *Salmonella schottmuelleri, Salmonella typhimurium, Salmonella typhosa, Serratia marcescens, Shigella flexnerie* Type II, *Shigella sonnei*, and *Virbrio cholera.*

Viruses:

Adenovirus Type IV, Feline pneumonitis, Herpes Simplex Type I & II, HIV-1 (AIDS), Influenza A (Japan), Influenza A2 (Aichi), Influenza A2 (Hong Kong), Parinfluenza (Sendai), Poliovirus, Reovirus, and Respiratory Synctia.

Fungi and Mold:

*Alternaria alternate, Asperigillus niger, Aureobasidium pullulans, Candida albicans, Cladosporium cladosporioides, Drechslera australiensis, Gliomastix cerealis, Microsporum audouinii, Monilia grisea, Phoma fimeti, Pithomyces chartarum, Scolecobasidium humicola, Trychophyton interdigitale*, and *Trychophyton mentagrophytes.*

The treatment and bonding of a material (substrate) with an antimicrobial agent of the subject invention can be carried out in a simple manner. Free hydroxyl groups provide for bonding of the antimicrobial agent to the substrate, so that the agent is not readily washed off or leached from the substrate after it has been applied thereto. For example, an antimicrobial agent useful for the subject invention can be applied to a substrate by immersing the substrate in an aqueous or alcoholic solution comprising the agent, so that an effective amount of the agent adheres to substantially all of the substrate's surface.

The quantity of the antimicrobial agent required to render a substrate "antimicrobial" can vary, but 1,000 to 10,000 ppm of a the antimicrobial agent in the solution is generally sufficient, although in some cases up to 100,000 ppm of the compound may be required in the solution. Also, immersion times of 1 to 60 minutes are generally sufficient, although immersion times of only about 5 to 10 minutes are frequently preferred.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A tennis ball comprising a pressurized inner rubber core and a felt cover, said felt cover comprising an antimicrobial agent that mechanically interacts with a microbe contacting said felt cover to inhibit, prevent proliferation of, or kill said microbe.

2. The tennis ball as in claim 1, wherein said antimicrobial agent electrostatically attracts said microbe to the antimicrobial agent.

3. The tennis ball as in claim 1, wherein said antimicrobial agent is chemically bonded to said felt cover prior to said felt cover being attached to said rubber core.

4. The tennis ball as in claim 1 wherein the felt cover comprises fibers or filaments.

5. The tennis ball of claim 4, wherein the antimicrobial agent is covalently bonded to the fibers or filaments of said felt cover.

6. The tennis ball as in claim 1 wherein said antimicrobial agent is a polymer comprising a plurality of carbon chains forming a microscopic bed of spikes that physically or mechanically inhibits or kills said microbe by puncturing an outer cell membrane of said microbe coming in contact with the surface of said ball and said felt.

7. The tennis ball of claim 1 wherein the antimicrobial agent has a chemical formula selected from the group consisting of:

$(CH_3O)_3Si(CH_2)_3N^+(CH_3)_2C_{18}H_{37}Cl^-$ $(CH_3CH_2O)_3Si(CH_2)_3N^+(CH_3)_2C_{18}H_{37}Cl^-$ $(CH_3O)_3Si(CH_2)_3N^+(CH_3)_2C_{18}H_{37}Br^-$ $(CH_3O)_3Si(CH_2)_3N^+(C_{10}H_{21})_2CH_3Cl^-$ $(CH_3O)_3Si(CH_2)_3N^+(CH_3)_2C_{14}H_{29}Cl^-$ $(CH_3O)_3Si(CH_2)_3N^+(CH_3)_2C_{14}H_{29}Br^-$ $(CH_3O)_3Si(CH_2)_3N^+(CH_3)_2C_{16}H_{33}Cl^-$.

8. The tennis ball of claim 7 wherein the antimicrobial agent has the chemical formula:

$(CH_3O)_3Si(CH_2)_3N^+(CH_3)_2C_{18}H_{37}Cl^-$.

9. The tennis ball of claim 1 wherein said antimicrobial agent is 3-trimethoxysilylpropyloctadecyldimethyl ammonium chloride.

10. A method for providing an antimicrobial tennis ball for inhibiting, preventing, or killing a microbe contacting said tennis ball during use of said tennis ball in a sport or game, said method comprising providing an antimicrobial agent which bonds to a material used in forming an outer surface of said tennis ball, bonding said antimicrobial agent to said outer surface material prior to manufacture of said tennis ball, and manufacturing said tennis ball using said surface material comprising the antimicrobial agent.

11. The method of claim 10 wherein said outer surface material is a fibrous or filamentous textile.

12. The method of claim 10 wherein said antimicrobial agent is chemically bonded to said outer surface material.

13. The method of claim 12 wherein said chemical bond is a covalent bond.

14. The method of claim 10, wherein said outer surface material is a felt material for a tennis ball.

15. The method of clam 10 wherein said antimicrobial agent is 3-trimethoxysilylpropyloctadecyldimethyl ammonium chloride.

16. A method for inhibiting or preventing contamination of a tennis ball during use of said tennis ball piece during a sport or game, said method comprising providing an tennis ball piece comprising an antimicrobial agent bonded to an outer surface of said tennis ball, using said tennis ball during a sport or game wherein said antimicrobial agent prevents, inhibits, or kills a microbe contacting said tennis ball during its use in said sport or game.

17. The method of claim 16 wherein said contamination is cross-contamination from one person contacting said sports tennis ball piece to another person contacting said tennis ball.

18. The method of claim 16 wherein said antimicrobial agent is 3-trimethoxysilylpropyloctadecyldimethyl ammonium chloride.

* * * * *